United States Patent [19]

Freisler et al.

[11] 4,365,653

[45] Dec. 28, 1982

[54] APPARATUS FOR COUPLING A HARNESS-MOTION TO A HARNESS FRAME OF A LOOM

[75] Inventors: Erhard Freisler, Bubikon; Paul Haltmeier, Brugg, both of Switzerland

[73] Assignee: Ruti Machinery Works Ltd., Ruti, Switzerland

[21] Appl. No.: 189,822

[22] Filed: Sep. 23, 1980

[30] Foreign Application Priority Data

Sep. 28, 1979 [CH] Switzerland ..... 8783/79

[51] Int. Cl.[3] ..... D03C 13/00; D03C 9/00

[52] U.S. Cl. ..... 139/88; 139/57; 403/206; 24/241 R

[58] Field of Search ..... 139/88, 84, 82, 57, 139/58, 81; 403/206; 24/241 R

[56] References Cited

U.S. PATENT DOCUMENTS 3,074,438 1/1963 Svaty ..... 139/91
3,696,842 10/1972 Pfarrwaller ..... 139/57

FOREIGN PATENT DOCUMENTS 2311873 12/1976 France ..... 139/57
740875 6/1980 U.S.S.R. ..... 139/82

*Primary Examiner*—James Kee Chi
*Attorney, Agent, or Firm*—Donald D. Denton

[57] ABSTRACT

An apparatus for coupling a harness-motion to a harness frame, the coupling end of the harness-motion being a harness-motion hook having a jaw capable of receiving a correspondingly shaped counterpiece secured to the harness frame, the harness-motion hook provided with a supporting surface adjoining the jaw for the supporting of the counterpiece before the coupling of the harness-motion hook and the counterpiece.

12 Claims, 3 Drawing Figures

APPARATUS FOR COUPLING A HARNESS-MOTION TO A HARNESS FRAME OF A LOOM

BACKGROUND OF THE INVENTION

The present invention relates to an apparatus for coupling a harness-motion to a harness frame of a loom, having a harness-motion hook with a jaw for receiving a correspondingly shaped counterpiece.

In prior art devices of this type in which the hook with the jaw forms the coupling end of the harness-motion and the counterpiece is mounted on the harness frame, problems always result if a harness-motion hook is to be coupled with a harness frame, as is the case upon each insertion of the harnesses into the loom. Such prior art devices are depicted by Swiss Pat. No. 545,871 and French Patent Application No. 77,33863, the disclosures of which patent and application are incorporated herein by reference. These problems reside in the fact that in order to couple the harness-motion hook to the harness frame on the one hand, the harness must be lowered towards the harness-motion hook and held at a height which makes it possible to receive the counterpiece or clamped member attached to the harness frame in the jaw of the hook and, on the other hand, the jaw must be swung over the counterpiece to complete the coupling. These different operations are cumbersome and time-consuming for the operating personnel and delay undesirably the insertion of the harnesses. In addition to this, each harness must be coupled with at least two, and in the case of wider looms even more than two, harness-motion hooks and the difficulty of said operations increases with the number of harnesses to be inserted.

The closest prior art known to applicants in connection with this application is in the above-mentioned Swiss Pat. No. 545,871 and French Patent Application No. 77-33863.

SUMMARY OF THE INVENTION

The above described disadvantages are overcome by the apparatus of the present invention in which there is provided an apparatus for the coupling of a harness-motion to a harness frame which permits of the greatest possible convenience and optimum comfort in operation, and in particular allows for the insertion of a harness in a quick and easy manner. This ease of coupling is achieved by providing a support adjoining the bottom of the jaw for supporting the counterpiece during the carrying out of the coupling operation. By this support, the insertion of the harnesses is made substantially easier since now, as a result of the supporting of the counterpieces, they are automatically held at the necessary height.

A preferred embodiment, in which the hook with the jaw forms the coupling end of the harness-motion and the counterpiece is mounted on the harness frame, is characterized by the fact that the support is provided on the harness-motion hook.

The operation of the apparatus is further facilitated if, as in one preferred embodiment, the support surface is in the form of a resting surface which adjoins the surface forming the lower limitation of the jaw, since in the case of this embodiment, the coupling of the harness to the harness-motion hook takes place by a simple swinging of the latter, the counter-piece sliding from rest on the support surface into the jaw.

In order to make this possible, in accordance with another preferred embodiment an adjustment member is associated with each harness-motion hook in order to adjust the harness-motion hook in a first position of swing in which, on the one hand, the tip of the hook lies outside the vertical path of movement of the counterpiece and on the other hand the resting surface lies in said path.

By means of the adjusting member the harness-motion hooks can be positioned in such a manner that, on the one hand, the hook points do not interfere with the lowering of the counterpiece onto the support surfaces and thus that of the harnesses to the desired height while, on the other hand, the counterpieces are definitely supported by the supporting surfaces.

An additional facilitating of operation is obtained in another preferred embodiment which is characterized by an adjustment member, associated with each harness-motion hook, for swinging the harness-motion hook from its first position of swing into a second position of swing in which the counterpiece is received into the jaw.

The displacement member permits in simple manner the swinging of the harness-motion hooks in order to receive in the jaw of the hook the counterpieces lying on the supporting surfaces.

In accordance with another preferred embodiment, a common adjusting member and/or a common displacement member is provided for each row of harness-motion hooks.

Thus, upon the insertion of the harnesses, the harness hooks can first of all be brought by the adjustment member into their first position of swing, whereupon the harnesses are inserted and lowered with their counterpieces onto the resting surfaces and thereupon the connections between the harness-motion and the harness are produced by the displacement member. This can be done individually or else jointly for all harness-motions of a row.

BRIEF DESCRIPTION OF THE DRAWINGS

The invention will be further described below with reference to illustrative embodiments in the figures of the drawing, in which.

DESCRIPTION OF THE PREFERRED EMBODIMENTS

Figure 1:
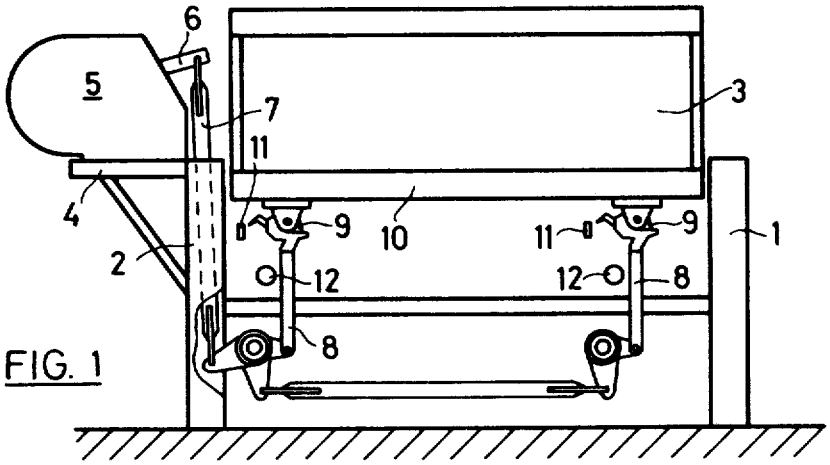
FIG. 1 is a diagrammatic front view in elevation of a loom with a harness and its drive.

In the case of the loom shown diagrammatically in FIG. 1, the side walls are designated 1 and 2. Guides (not shown) are provided on the side walls and the harnesses (of which only one harness 3 is shown) are guided displaceably in vertical direction in said guides. For the driving of the harnesses there is used a dobby 5 which is arranged on a support plate 4 connected to side wall 2. Each harness swing arm 6 of the dobby 5 is connected, via a drive lever 7 and various rockers and push-and-pull rods forming the harness-motion, with harness-motion hooks 8. Each of these harness-motion hooks 8 engages a separate counterpiece 9 fixed to a harness frame 10.

As shown in the drawing, each harness frame 10 has two counterpieces 9 and accordingly there are two harness-motion hooks 8 for each harness 3. Of course, the number of harness-motion hooks 8 per harness 3 can vary; in very narrow looms, for instance in ribbon looms, one harness-motion hook 8 per harness 3 is sufficient, and in wide looms three or more harness-motion hooks 8 per harness 3 may possibly be provided.

Each of the two rows of harness-motion hooks 8 has an adjustment member 11 and a displacement member 12 associated with it. The adjustment members 11 are bar-shaped and are arranged in the loom perpendicular to the plane of the harnesses 3 and thus in the warp direction. The adjustment members 11 serve to fix the harness-motion hooks 8 in a first position of swing for the insertion of the harnesses 3. The displacement members 12 which are arranged parallel to the adjustment members 11 are each formed by a shaft provided with cams and serve to swing the harness-motion hooks 8 after insertion of the harnesses 3 from a first position of swing into a second position of swing in which the harnesses 3 are coupled with the harness-motion hooks 8. On the shaft of the displacement members 12 an eccentric 30 (FIG. 3) is associated with each harness-motion hook 8 so that the swinging of the harness-motion hooks 8 from the first position of swing into the second position of swing can take place in each case after the insertion of the corresponding harness 3 and therefore harness by harness or else, after the insertion of all harnesses 3, jointly for all harness-motion hooks 8 of each row.

Figure 2:
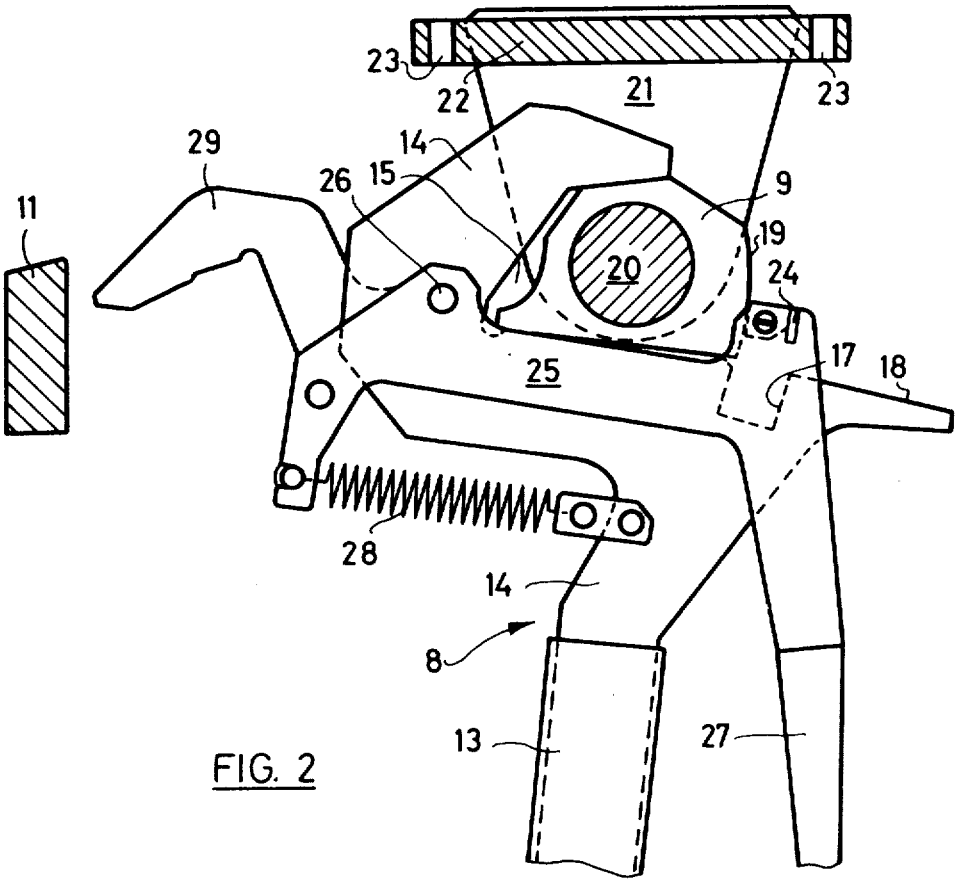
FIG. 2 is a partial view of a coupling apparatus with the counterpiece engaged by the harness-motion hook.
Figure 3:
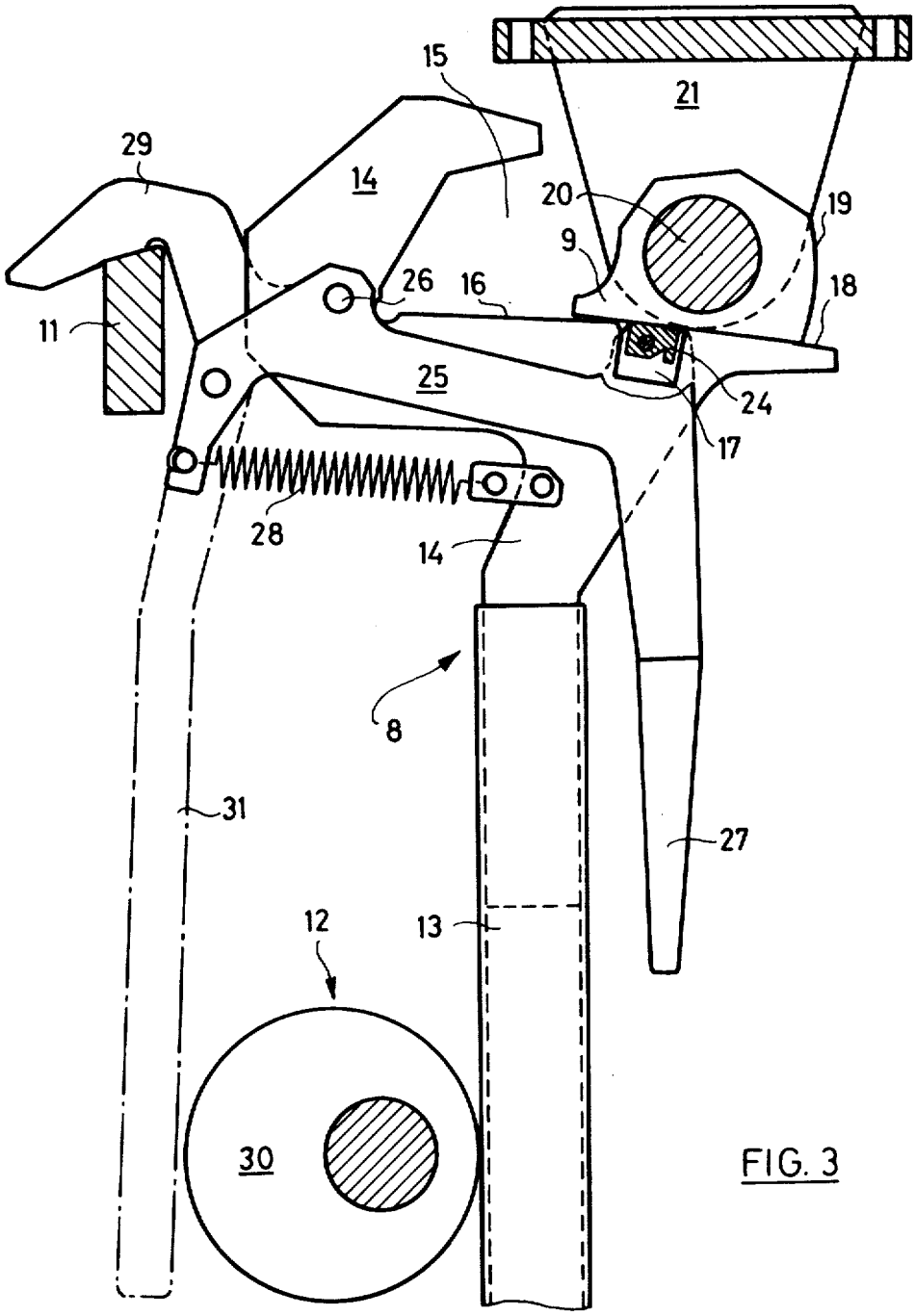
FIG. 3 is a view of a coupling apparatus with the counterpiece resting on the support surface.

FIGS. 2 and 3 show in detail the coupling device between a harness and its harness-motion for two different operating positions. The figures show a front view of a counterpiece 9 and the end of a harness-motion hook 8 surrounding same, which hook is shown in its second position of swing in FIG. 2 and in its first position of swing in FIG. 3.

The harness-motion hook 8 consists of a hollow profile 13 into the upper end of which a hook 14 is inserted. The hook 14 which is connected to the hollow profile 13 by, for instance, spot welding or by other connecting means, has a jaw 15 which narrows from the opening of the jaw towards the rear and adjoins the surface 16 which forms the lower limitation of the jaw 15. In the direction away from the jaw 15, there is provided an incision or notched-out portion 17 and adjoining the latter a resting surface 18. The resting surface 18 is essentially aligned with the surface 16 of the hook jaw 15 but is inclined by a few angular degrees to that surface.

The contour of the counterpiece 9 is so formed that it is adapted to fit the hook jaw 15 and has two surfaces of the contour which are conically tapered towards each other and which rest against the corresponding surfaces of the hook jaw 15. On the part of the counterpiece 9 extending out of the hook jaw 15, the counterpiece is limited by an arcuate surface 19. The counterpiece 9 is supported on a stub shaft 20 which in turn is held by two spaced straps 21. In the figures, the counterpiece 9 is cut just below the front strap. The straps 21 are welded or otherwise secured at their base to an elongated fastening part 22 which is provided with boreholes 23 which serve to receive fastening screws by which the fastening part 22 and thus the counterpiece 9 can be fastened to the harness frame 10. The fastening part 22 and the straps 21 form a block of U-shaped cross-section in which the stub shaft 20 and the counterpiece 9 borne by it are held.

In order to prevent the counterpiece 9 sliding out from the hook jaw 15 upon the operation of the loom, a securing or locking element or safety element 24 is provided which presses against the arcuate surface 19 of the counterpiece 9. The securing element 24 has the shape of a block of approximately T-shaped cross-section and is inserted between two wall parts 25 which surround the hook 14 and are swingably supported on the hook 14. Each of the wall parts 25 represents a double-armed lever swingable about a pin 26. The one arm of this lever extends away from the pin 26 initially approximately parallel to the hook jaw surface 16 and to the resting surface 18 and bears the securing element 24. Approximately in the region of the securing element 24 the said lever arm is bent downward and terminates in an actuating finger 27.

The second lever arm extends obliquely downward from the pin 26; the one end of a tension spring 28 acts on its free end, the other end of said spring being fastened to the hook 14. By means of the spring 28, the block which forms the securing element 24 is swung upward until, as shown in FIG. 2, it rests against the surface 19 of the counterpiece 9. In this way assurance is had that the counterpiece 9 is fixed in the hook jaw 15. This fixing can only be done away with by swinging the securing element 24 downward. This is done by swinging the actuating finger 27 against the force of the spring 28, as a result of which the securing element 24 is moved along the surface 19 downward into the incision or notched opening 17.

A second hook 29 which is open towards the bottom is provided on the second lever arm of one of the two wall parts, for instance the rear wall part 25 as shown in the drawing. By means of this hook the harness-motion hook 8 can be fixed, as shown in FIG. 3, on the adjustment member 11. The adjustment member 11, as shown in the drawing, has the shape of a bar of approximately rectangular cross-section; of course, its cross-section could, for instance, also be round. The jaw of the hook 29 is adapted to the cross-section of the adjustment member 11 and the end of the hook 29 is so dimensioned that, when the actuating finger 27 is swung fully against the hollow profile 13, the hook 29 can slide over the adjustment member 11. Thereupon the hook can engage into the adjustment member 11, the actuating finger 27 swinging back somewhat from the hollow profile 13 but only to such an extent that the block which forms the securing element 24 remains within the incision 17 and does not extend out of it.

The swinging of the harness-motion hook 8 into its first position of swing shown in FIG. 3, which position is always required before the replacement of the inserted harnesses 3 or the insertion of new ones, is effected manually by pressing the actuating finger 27 against the hollow profile 13 and then swinging the harness-motion hook 8 in counterclockwise direction until the hooks 29 engage in the adjustment member 11.

As can be noted from FIG. 3, in the first position of swing of the harness-motion hook 8 on the one hand the tip of the hook 14 is located outside the vertical path along which the counterpiece 9 is moved upon the insertion or removal of a harness 3, and on the other hand the supporting surface 18 lies in this path and limits it toward the bottom. When a harness 3 is inserted in the machine, it can thus slide freely downward until the counterpiece 9 comes against the supporting surface 18 and is held by the latter at the height required in order to receive the counterpiece 9 in the hook jaw 15.

In order to produce the coupling between harness-motion hook 8 and counterpiece 9 and thus the harness 3, it is merely necessary, after insertion of the harnesses 3, for the harness-motion hooks 8 to be swung in clockwise direction. This swinging is effected, either each individually or all harness-motion hooks 8 in a row jointly, by actuating a lever (not shown) which is connected with the displacement member 12, whereby, by means of the eccentric or eccentrics against which the harness-motion hooks rest, the latter are swung in the desired direction by the desired amount.

Upon this swinging motion the hook jaw 15 slides over the counterpiece 9 which slides from the supporting surface 18 continuously onto the jaw surface 16, closes the incision 17 on the top and prevents the securing element 24 from swinging upward out of the incision 17 due to the force of the spring 28. As soon as the counterpiece 9 is completely received by the hook jaw 15 and the harness-motion hook 8 has reached its second position of swing, the securing element 24 swings upward out of the incision 17 until it rests against the surface 19 of the counterpiece 9. The position shown in FIG. 2 is thus reached.

When the coupling between harness-motion hook 8 and counterpiece 9 is produced, the displacement member 12 is again brought into the position of rest shown in FIG. 3. Of course, the swinging of the harness-motion hook 8 from the first position of swing into the second position of swing could also be effected manually so that the displacement member 12 could be dispensed with.

The swinging of the harness-motion hooks 8 into their first position of swing can be effected by the displacement member 12 if a displacement lever 31 is mounted on the free end of the second lever arm of the wall parts 25, as shown in dot-dash line in FIG. 3. This displacement lever 31 extends downward and rests against the side of the eccentric 30 which is away from the harness-motion hook 8. In the second position of swing of the harness-motion hook 8 (FIG. 2), in which position the displacement member 12 is turned 180° from the position shown in FIG. 3, the securing member 24 would then, by turning the displacement member 12, first of all be swung into the incision 17 and then via the displacement lever 31 of the harness motion hook 8 from its second position of swing into its first position of swing.

It is clear that in this case where the eccentric 30 controls two members lying on opposite sides, namely the harness-motion hook 8 and the displacement lever 31, all harness-motion hooks 8 of a row can always only be swung jointly. In order to prevent frictional forces occurring between the eccentric 30 and the said members during the operation of the loom, it will be seen to it that there is a certain play between these elements in the second position of swing of the harness-motion hooks 8.

In the embodiment shown in the figures the hook 14 with the jaw 15 is formed by the coupling end of the harness-motion hook 8 and the counterpiece 9 is mounted on the harness frame 10. Of course, this could also be reversed, i.e. the hook 14 with the jaw 15 and the resting surface 18 could be fastened to the harness frame 10 and the counterpiece 9 to the harness-motion hook 8.

Although the invention is described in detail for the purpose of illustration, it is to be understood that such detail is solely for that purpose and that variations can be made therein by those skilled in the art without departing from the spirit and scope of the invention except as it may be limited by the claims.

What is claimed is:

1. An apparatus for coupling a harness-motion to a harness frame of a loom, having a hook, said hook having a jaw with a hook jaw surface adapted to receive a correspondingly shaped counterpiece, and having a resting surface for the counterpiece, said resting surface adjoining the hook jaw surface.

2. The apparatus according to claim 1 in which the hook with the jaw forms the coupling end of the harness-motion and the counterpiece is mounted on the harness frame, characterized by the fact that the resting surface is provided on the harness-motion hook.

3. The apparatus according to claim 2 in which the hook jaw surface is formed by the surface forming the lower limitation of the jaw.

4. The apparatus according to claim 3 having at least one harness-motion hook in which an adjusting member is associated with each harness-motion hook for adjusting the harness-motion hook in a first position of swing in which, on the one hand, the point of the hook lies outside the vertical path of movement of the counterpiece and on the other hand the resting surface lies in said path.

5. The apparatus according to claim 4 in which a displacement member is associated with each harness-motion hook for swinging the harness-motion hook from its first position of swing into a second position of swing in which the counterpiece is received by the jaw.

6. The apparatus according to claim 5 in which a common adjustment member and a common displacement member are provided for each row of harness-motion hooks.

7. The apparatus according to claim 3 in which a securing element prevents unintended release of the counterpiece from the jaw, said element being supported for swinging on the harness-motion hook perpendicular to the supporting surface.

8. The apparatus according to claim 7 in which an incision to receive the securing element is provided between the surface forming the lower limitation of the jaw and the resting surface.

9. The apparatus according to claim 8 in which the securing element is held by two wall parts which surround the hook on the outside, each of said wall parts having the shape of a double-armed swing lever, on the one arm of which a spring acts and whose other arm terminates in an actuating finger, said actuating finger being provided in order to swing the wall parts and thus the securing element against the force of the spring.

10. The apparatus according to claim 9 in which a second hook is developed on the one arm of one of the two wall parts, said hook being intended for engagement with an adjustment member.

11. The apparatus according to claim 10 in which the adjustment member is formed by an elongated support for the second hook, which support is arranged perpendicular to the plane of the harnesses, and the displacement member is formed by a shaft which is arranged parallel to the adjustment member and is provided with displacement eccentrics for the harness-motion hooks.

12. The apparatus according to claim 11 in which the one arm of the double-armed swing lever on which the spring acts bears a displacement arm which lies on the side of the associated displacement eccentric which faces away from the harness-motion hook and is intended in the second position of the harness-motion hook for the swinging of the securing element against the force of the spring and thereupon for the swinging of the harness-motion hook from its second position of swing into its first position of swing by means of the displacement eccentric.

* * * * *